United States Patent [19]

Kuo

[11] 4,312,287

[45] Jan. 26, 1982

[54] APPARATUS FOR HANDLING SUBMERSIBLES AT SEA

[75] Inventor: Chengi Kuo, Glasgow, Scotland

[73] Assignee: The University of Strathclyde, Glasgow, Scotland

[21] Appl. No.: 946,369

[22] Filed: Sep. 27, 1978

[30] Foreign Application Priority Data

Sep. 30, 1977 [GB] United Kingdom ..... 40637/77

[51] Int. Cl.[3] ..... B63B 35/02

[52] U.S. Cl. ..... 114/259; 114/61; 405/185; 414/137; 414/141

[58] Field of Search ..... 114/53, 66, 256, 258, 114/264, 265, 266, 267, 270, 312, 313, 314, 321, 322, 324, 325, 334, 335, 259, 260, 44, 49, 50, 51; 405/185, 188, 189, 192, 193, 194; 212/3; 414/137–141

[56] References Cited

U.S. PATENT DOCUMENTS

| | | | |
|---|---|---|---|
| 597,597 | 1/1898 | Webb | 405/192 |
| 1,225,662 | 5/1917 | Lee | 114/322 |
| 1,814,642 | 7/1931 | Spear | 114/312 |
| 2,564,966 | 8/1951 | Farrell | 212/3 |
| 3,393,524 | 7/1968 | Terrell | 405/185 |
| 3,507,241 | 4/1970 | Southerland, Jr. et al. | 114/259 |
| 3,641,961 | 2/1972 | Howard | 405/185 |
| 3,653,354 | 4/1972 | Pangalila | 114/265 X |
| 3,766,874 | 10/1973 | Helm et al. | 114/264 |
| 3,807,334 | 4/1974 | Egeberg | 114/259 |
| 3,807,335 | 4/1974 | Talkington | 114/44 |
| 3,996,870 | 12/1976 | Haavie | 114/66 |
| 4,010,740 | 3/1977 | Mayo et al. | 114/267 |
| 4,069,785 | 1/1978 | Bordes | 114/258 X |

FOREIGN PATENT DOCUMENTS

| | | | |
|---|---|---|---|
| 503176 | 5/1951 | Belgium | 414/141 |
| 370891 | 2/1907 | France | 405/185 |
| 917337 | 1/1947 | France . | |
| 2242290 | 3/1975 | France | 114/264 |
| 18352 | of 1913 | United Kingdom | 114/259 |
| 120102 | 10/1918 | United Kingdom | 405/189 |
| 1179297 | 1/1970 | United Kingdom . | |

*Primary Examiner*—Galen L. Barefoot

*Attorney, Agent, or Firm*—Gerald J. Ferguson, Jr.; Joseph J. Baker

[57] ABSTRACT

A ship or other vessel having a moonpool therein and an enclosed space above the moonpool is provided with a pontoon which floats on the surface of the sea within the moonpool. The effects of the enclosed space is that said sea surface is calm even when the ambient sea is subject to an adverse swell, and the effect of the pontoon is that it will remain substantially stationary and be independant of the vessels heaving motion, i.e. the pontoon is de-coupled from the vessel. Lifting gear mounted on the pontoon is used to lower and raise submersibles, sub-sea equipment, tethered bells or divers (tethered or free swimming). The pontoon may be used as a stable work area and for loading and unloading cargo; in the latter case, a housing forming the enclosed space above the moonpool has a double opening through which the cargo can pass, but only on opening at a time is opened so as to preserve the enclosed space above the moonpool.

3 Claims, 20 Drawing Figures

APPARATUS FOR HANDLING SUBMERSIBLES AT SEA

This invention relates to apparatus for and method of handling submersibles or sub-sea equipment at sea and/or cargo at sea.

The usual method of handling a free floating submersible from a vessel is to suspend it from a crane, such as an A-frame and lower it over the stern of the vessel onto the surface of the sea, after which the crane's lifting hook is manually released from the submersible's lifting point. To recover the submersible it must first return to the surface and come close enough to the mother ship to permit a tow-line from the vessel to be attached to the submersible. This is done manually by a person from a dinghy (usually a diver) who then sits astride the submersible as it is drawn closer to the vessel. Once it is under the A-frame the diver then attaches a lifting hook to the submersible's lifting point and the submersible can then be lifted out of the water and brought on board the mother ship. A disadvantage of handling a submersible is that in a heavy swell or rough sea the vessel's movements, particularly heaving and pitching, make it difficult for manual connection or disconnection of the lifting hook to or from the submersible. In addition, the lifting cable carrying the submersible will be subject to snatch loads. As a result, launching or recovery operations in such conditions may have to be delayed or curtailed.

Tethered sub-sea equipment such as diving bells are also launched over the stern of a vessel or through an open shaft, i.e. an inside well known as a "moonpool," passing through the vessel, but again, the motions of the vessel in a heavy swell or rough sea will transmit a rising and falling motion to the submerged bell which motion may have an adverse effect on the occupants of the bell. Also the lifting cable may be subject to possible snatch loads during the phase of lifting or lowering through air/water interface.

An improved moonpool has been devised and is the subject of pending U.S. patent application Ser. No. 838,440, filed Sept. 30, 1977, and its corresponding United Kingdom application No. 40859/76. This improved moonpool provides more suitable sea conditions within the moonpool than heretofore by eliminating or reducing the surging amplitude of the sea within the moonpool to a minimum. This enables easier lifting or lowering of the bell into or out of the moonpool particularly through the calmed air/sea interface but the heaving motion of the vessel will still affect a submerged bell.

A disadvantage of handling cargo at sea, e.g., the transferring of stores from a supply vessel to a rig, is that in a heavy swell or rough seas, the vessel is constantly heaving relative to the rig which, of course, is stationary, and securing the cargo to the lifting hook of the rig's derrick is difficult. The lifting cable is again subject to snatch loads due to the heaving motion of the vessel.

In the specification the expression "moonpool" when related to a ship or barge refers to a shaft which passes through the vessel from keel to a deck level or 'tween deck level, the lower end being open to the sea and the upper end being open to atmosphere, either directly when opening into an exposed or partially enclosed deck or indirectly when opening into a hold or similar area between decks.

The term 'sea' should be interpreted as including areas of salt water and areas of fresh water.

The term "vessel" should be interpreted as including ships barges and semi-submersibles.

An object of the present invention is to obviate or mitigate the aforesaid disadvantages.

According to one aspect of the present invention there is provided on a vessel having a moonpool and means providing an airtight or nearly airtight enclosed space above the surface of the sea within the moonpool, a pontoon which floats on the sea surface within the moonpool.

Preferably, lift means is provided on said pontoon for use in lifting and lowering submersibles or sub-sea equipment through the moonpool.

Preferably also, the pontoon has a floating portion and a portion which can be lowered or raised by said lift and on which the submersible or sub-sea equipment can be located.

According to another aspect of the present invention there is provided apparatus for handling submersibles or sub-sea equipment through a moonpool of a floating vessel, comprising a pontoon which floats on the surface of the sea within said moonpool and lift means on said pontoon for lifting and lowering said submersible or sub-sea equipment through the moonpool, and an airtight or nearly airtight enclosed space provided above the moonpool and into which the upper end of the moonpool opens whereby a calm relatively stationary sea surface is provided in the moonpool relative to the ambient sea so that the pontoon will be substantially stationary relative to the movement of the vessel caused by the conditions of the ambient sea.

According to yet another aspect of the present invention there is provided apparatus for handling cargo at sea between a rig, platform or the like stationary structure and a floating vessel having a moonpool therein, said apparatus comprising a pontoon which floats on the sea surface within the moonpool, means providing an airtight or nearly airtight enclosed space above the moonpool and into which the moonpool opens whereby a substantially stationary sea surface is provided in the moonpool relative to the ambient sea so that the pontoon is substantially stationary relative to the movement of the vessel caused by the conditions of the ambient sea whereby loading cargo on to or unloading cargo from said pontoon can be performed, said means providing said enclosed space including at least two vertically spaced closable openings one of which has aperture means for passage of a lifting cable therethrough, whereby lift means on the rig, platform or like structure, can lift or lower cargo from or to said pontoon while the enclosed space is maintained airtight or nearly airtight to maintain the pontoon in its substantially stationary condition during the stage of lifting the cargo from or lowering the cargo on to the pontoon.

According to a further aspect of the present invention, there is provided a method of handling submersibles or sub-sea equipment through a moonpool of a ship, barge or other floating vessel, which vessel has means forming an airtight or nearly airtight enclosed space above said moonpool and into which said moonpool opens, said method comprising raising or lowering the submersible or sub-sea equipment through the moonpool using lift means mounted on a pontoon floating on the surface of the sea within the moonpool.

According to yet another aspect of the present invention there is provided a method of handling cargo at sea between a rig, platform or like stationary structure and a floating vessel having a moonpool therein and an airtight or nearly airtight enclosed space provided over said moonpool and into which the upper end of said moonpool opens, said method comprising using a pontoon on the surface of the sea within the moonpool to provide a stable area on to or from which cargo can be lowered or lifted, and providing a pair of vertically spaced closable openings in the means providing the enclosed space whereby cargo can be lifted out of or lowered into said enclosed space.

According to a further aspect of the present invention there is provided a semi-submersible having a moonpool structure extending from deck level to a level which is above the waterline when the semi-submersible is in its raised (transit) position, and below the waterline when the semi-submersible is in its lower (operating) position, whereby when the semi-submersible is in its lower position an enclosed space is formed above the surface of the sea within the perimeter of said structure, a pontoon located within the structure and means to support said pontoon above the sea surface when the semi-submersible is in its transit position and to locate the pontoon on the sea surface when the semi-submersible is in its operating position.

Embodiments of the present invention will now be described, by way of example, with reference to the accompanying drawings, in which.

Figure 1:
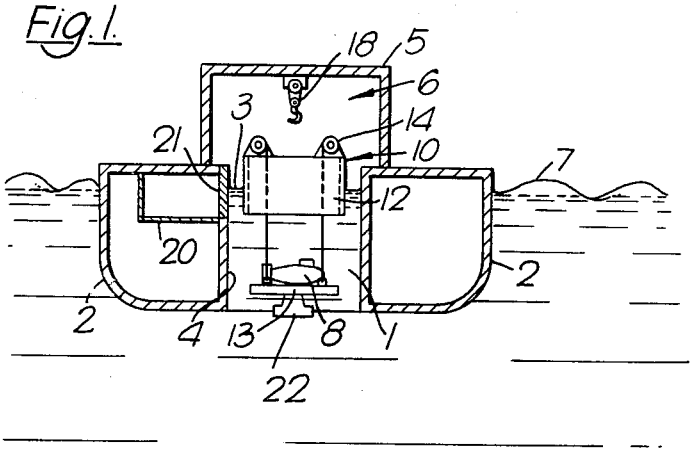
FIG. 1 is a diagrammatic cross sectional view of a ship having a moonpool and a pontoon thereon according to the present invention.
Figure 2:
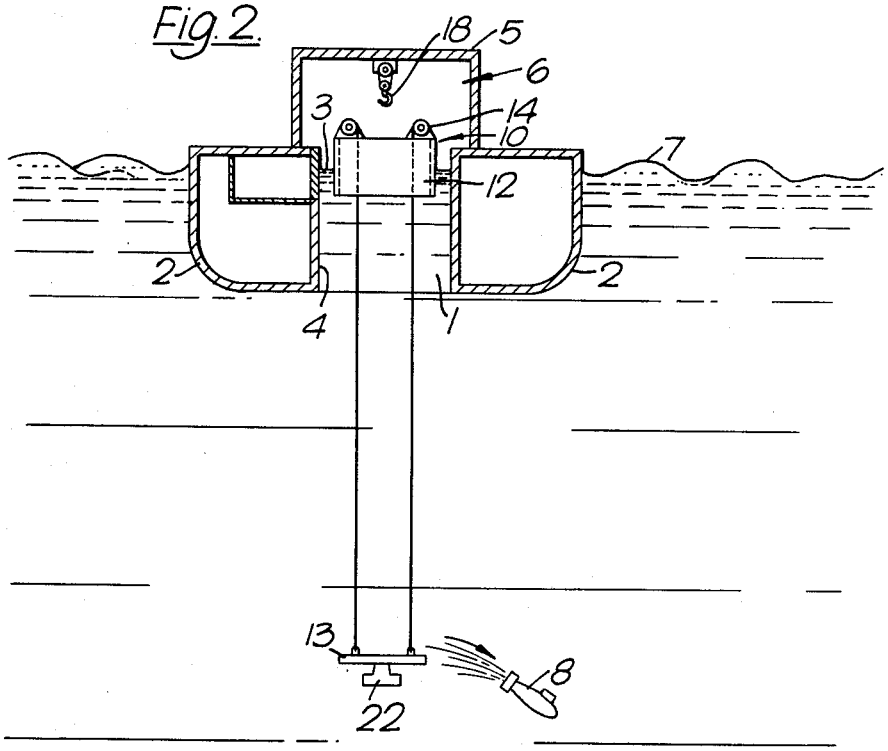
FIG. 2 is a view similar to FIG. 1 showing a part of the pontoon in a lowered position.

In the first embodiment (FIGS. 1 to 6), apparatus is provided for handling submersibles or sub-sea equipment through the moonpool 1 of a ship 2. Said apparatus comprises a pontoon 10 adapted for location in the moonpool 1 so as to float on the sea surface 3 therein. Buffer means 11 (FIG. 3) is provided to prevent the pontoon 10 being damaged or causing damage to the walls 4 of the moonpool or the pontoon may be weakly constrained.

In the preferred embodiment the pontoon 10 is formed of two parts, namely, a peripheral portion 12 which is buoyant for floating on the surface 3, and an inner platform or cradle 13 which can be lowered or raised through the moonpool by lift means 14 provided in the peripheral portion 12. When the cradle lies within the peripheral portion the two may be locked together.

The moonpool 10 opens into an airtight or nearly airtight enclosed structure 5 as more fully described in pending U.S. patent application Ser. No. 838,440, filed Sept. 30, 1977, and its corresponding United Kingdom application No. 40859/76 filed Oct. 1, 1976, a small amount of leakage being within allowable limits. The airtight or nearly airtight enclosed space 6 within the enclosure 5, i.e. above the moonpool, causes the sea surface 3 within the moonpool 1 to remain calm and substantially stationary even when the ambient sea 7 is subject to an adverse swell. In such conditions, the vessel 2 will be subjected to a heaving movement but the floating pontoon 10 will remain substantially stationary, i.e. it will be 'de-coupled' from the vessel, and the cradle 13 will not be subjected to a rising and falling motion as would be the case using lift means mounted on the moving vessel. The pontoon thus acts as a heave compensator.

The peripheral portion 12 on the pontoon may have upstanding side walls 15 to prevent water flooding the deck 16 of the pontoon when, for example, the load on the pontoon causes the deck level to sink below the level of the sea surface 3.

When a free floating submersible 8 is to be launched, see FIG. 1, it is located on the platform or cradle 13 of the pontoon 1, and holding means such as remote-control catches generally indicated as 17 are provided to retain the submersible on the cradle until the time for launching, when said means are released. The cradle is then lowered through the moonpool and at a safe depth the submersible moves off the cradle under its own power (see FIG. 2). When the submersible is to be recovered it homes-in on to the cradle which, because of the stability of the pontoon 10, is held substantially stationary at the desired depth. When the submersible is on the cradle 13 the holding means 17 are actuated to secure the submersible and the cradle 13 is raised towards the surface and through the moonpool into the area around the peripheral part of the pontoon. Thereafter the submersible can be removed to a storage bay either by its removal from the pontoon by means of, for example, a gantry crane 18 on the roof of the enclosure 5 or by removing the pontoon from the moonpool. To facilitate the latter, a drydock 20 is provided alongside the moonpool with a connecting gate 21 which, when open, and with the drydock flooded, permits movement of the pontoon between the moonpool and the drydock. Alternatively, the pontoon may be secured within the moonpool, e.g. by rams (not shown) extending downwards and which act against the pontoon's buoyancy to hold it on the surface of the sea within the moonpool; in another alternative the vessel is provided with brackets located below the pontoon and the vessel varies its draft so that at a deep draft the brackets are below the sea surface so that the pontoon floats on the sea surface while, at a shallower draft, the brackets are above the sea surface and support the pontoon thereabove.

Remote-controlled thrusters 22 may be provided on the cradle to counter possible swinging motion caused thereto by wave or current effect; this will simplify homing-in of the submersible on the cradle.

Figure 7:
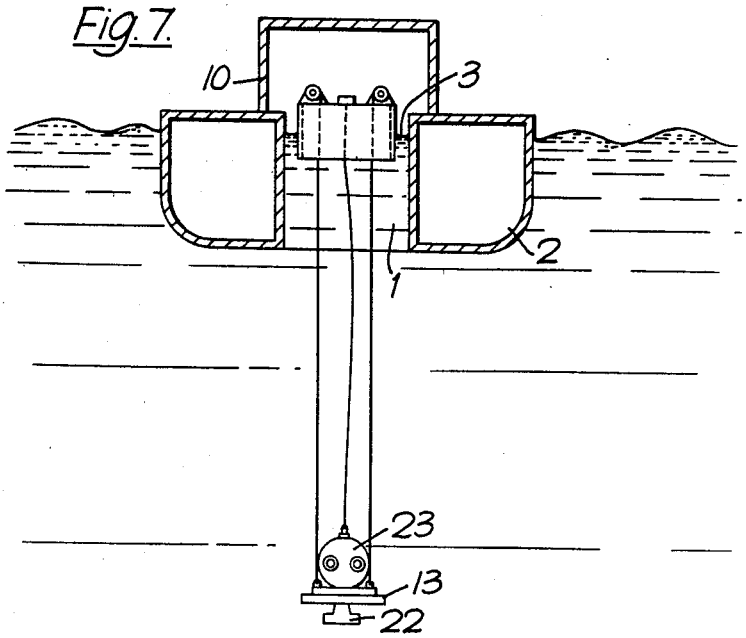
FIG. 7 is a view similar to FIG. 2 showing a tethered bell on the pontoon.
Figure 8:
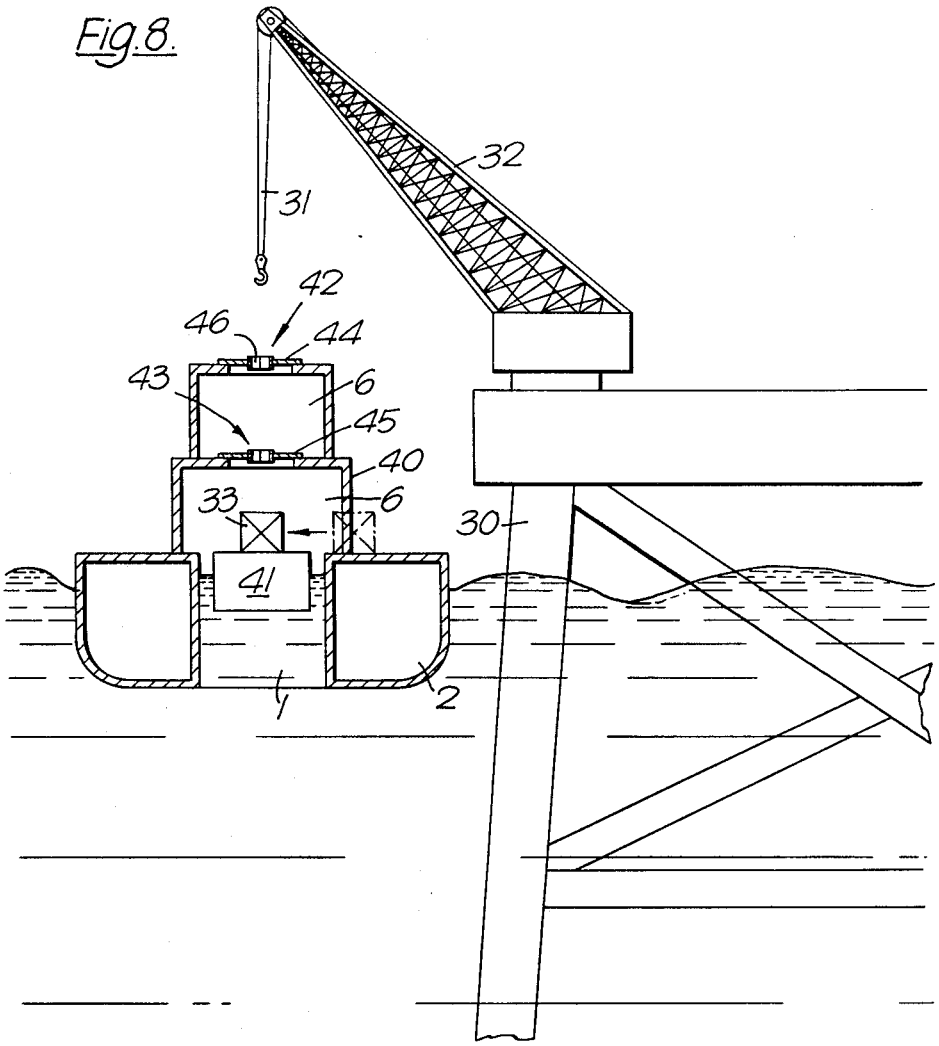
FIG. 8 is a diagrammatic illustration of a supply vessel in cross section alongside a stationary structure such as a rig, said vessel having pontoon means for loading and unloading cargo according to the invention.
Figure 9:
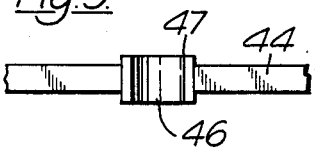
FIGS. 9 and 10 illustrate sliding hatch covers in side elevation and plan, the hatch covers being employed in connection with the supply vessel of FIG. 8.
Figure 10:
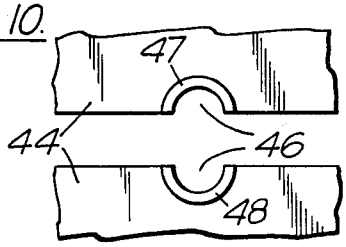

It will be appreciated that the cradle may carry a tethered submersible such as a diving bell 23 (FIG. 7). Again the cradle may be provided with remote-controlled thrusters 22 which can be used to direct the lowered tethered bell 23 in any desired substantially horizontal direction away from its vertical axis of suspension to increase the area of operation. Such a pendulous movement is made possible without adverse effects on the occupants of the bell because of the substantially stationary pontoon from which the bell is suspended and increases the bell's area of operation. The cradle may also be used to convey sub-sea equipment such as heavy tools, or even divers between the vessel and the sea bed; for example a diver in a one atmosphere tethered diving suit, such as the kind marketed under the Trade Marks JIM and WASP, can be lowered from the pontoon mounted lifting gear and will be able to work more efficiently than hitherto due to the stability of the lifting gear.

It will also be appreciated that the floating pontoon may be utilised as a stable working area on the surface in addition to the main function of serving as a stable base for the lift means while the cradle may be used as an underwater working area, (e.g. an underwater habitat).

The pontoon may take many different forms and may occupy substantially all or only part of the area of the sea surface within the moonpool. Examples are illustrated in FIGS. 3, 5 and 6.

Figure 3:
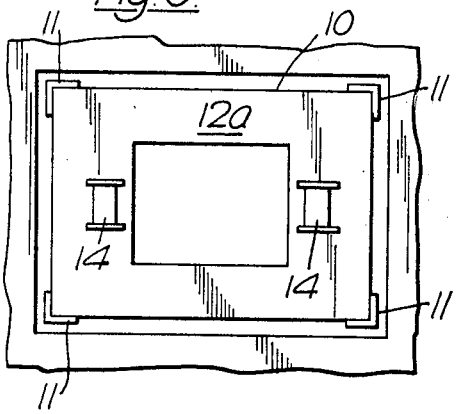
FIG. 3 is a plan view of one example of a pontoon in the moonpool.
Figure 4:
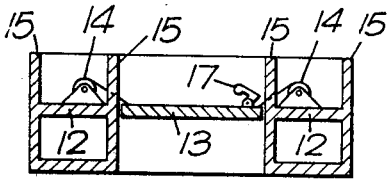
FIG. 4 is a sectional side elevation of a pontoon.

In FIG. 3, the pontoon is in the form of a peripheral buoyant portion 12*a* only with an open central area through which the submersible or sub-sea equipment can be lowered or raised.

Figure 5:
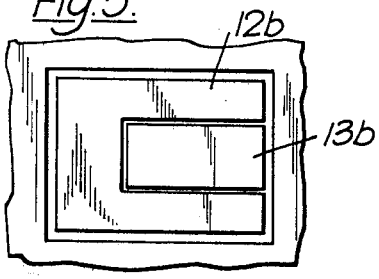
FIGS. 5 and 6 are plan views of alternative forms of pontoon.
Figure 6:
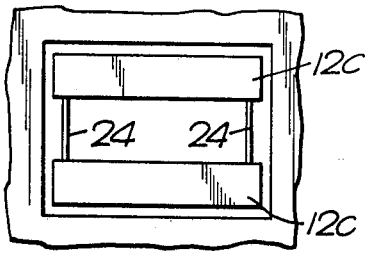

In FIG. 5 the pontoon and a U-shaped buoyant portion 12*b* with the platform or cradle 13*b* locatable within the area bounded by the three limbs of the buoyant portion. In FIG. 6 the pontoon comprises a pair of parallel buoyant portions 12*c* joined, for example, by a pair of bars 24 to provide an open area between the buoyant portions for passage of the submersible or sub-sea equipment.

In the second embodiment apparatus is provided for use in handling cargo at sea, namely, for transferring cargo between a rig, platform or other stationary structure 30, and a supply vessel provided with an enclosed moonpool 1. Such vessels normally have all superstructure formed and an open deck extending from midship to the stern. A vessel incorporating apparatus in accordance with the invention has a moonpool 1 which opens on to said open deck and an airtight or nearly airtight housing 40 on said deck enclosing the moonpool and a pontoon 41 floating in the sea surface 3 with the moonpool. The housing has a pair of vertically spaced openings 42, 43, each being closable by, for example, a pair of sliding hatchet covers 44 and 45. The upper hatch covers 44 when closed include an aperture 46 through which a cable 31 from a rig's derrick 32 can pass. Said aperture has a collar 47 to embrace the cable 31 and provide a substantially airtight closure. The collar 47 may be formed by two semi-circular pads each in a semi-circular niche 48 in the adjacent edge of the hatch covers 44, which niches form the aperture. This upper opening 42 can be opened for the passage of cargo 33 therethrough, but only when the lower opening 43 is closed see FIGS. 11 and 16 and vice versa—whereby the enclosed space 6 above the moonpool is retained airtight or nearly airtight, e.g. the lower opening 43 is opened to enable the cargo to be lowered on to or lifted from the pontoon 41 (FIG. 14) but it is closed before the upper opening is opened so that the pontoon remains substantially stationary even though the vessel is moving due to conditions of the ambient sea 7.

The housing 40 has inner and outer doors not shown to enable passage of cargo into and out of the housing while still maintaining the enclosed space sufficiently airtight within the housing.

Figure 11:
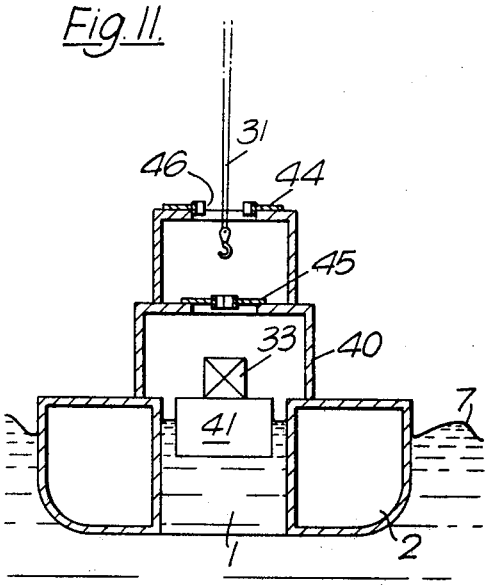
FIGS. 11 to 16 illustrate the stages of unloading the vessel.
Figure 12:
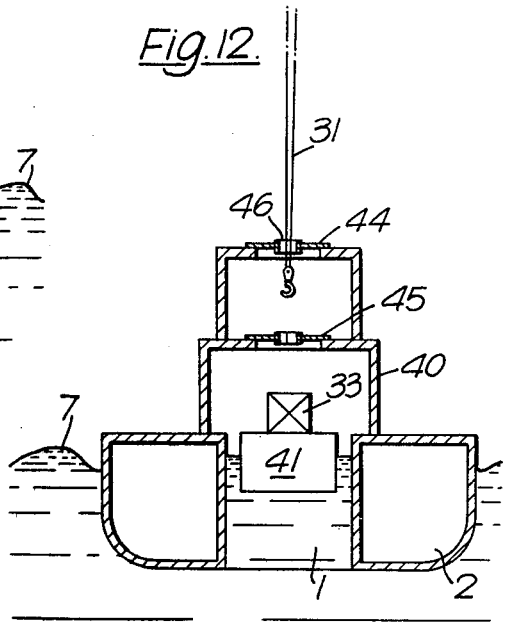

The procedure for unloading is as follows:

The lift cable 31 is lowered FIG. 11 through the upper opening 42 and the opening closed, FIG. 12. The closure is substantially airtight but a small amount of space in the cable aperture 46 will be within the allowable limits. The lower opening 43 is then opened FIG. 13 so that the cable can pass down for attachment to cargo 33 which has been transferred from the open deck on to the substantially stationary floating pontoon 41.

Figure 14:
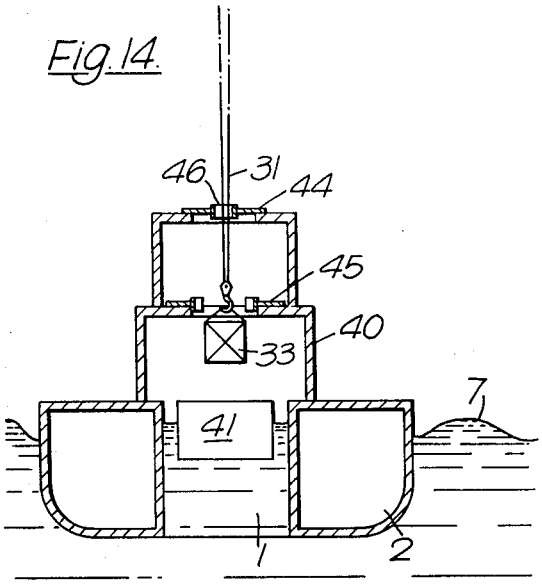
Figure 15:
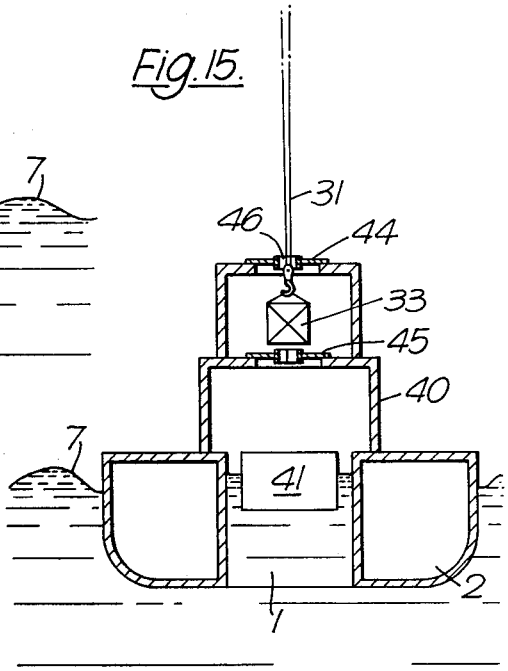
Figure 16:
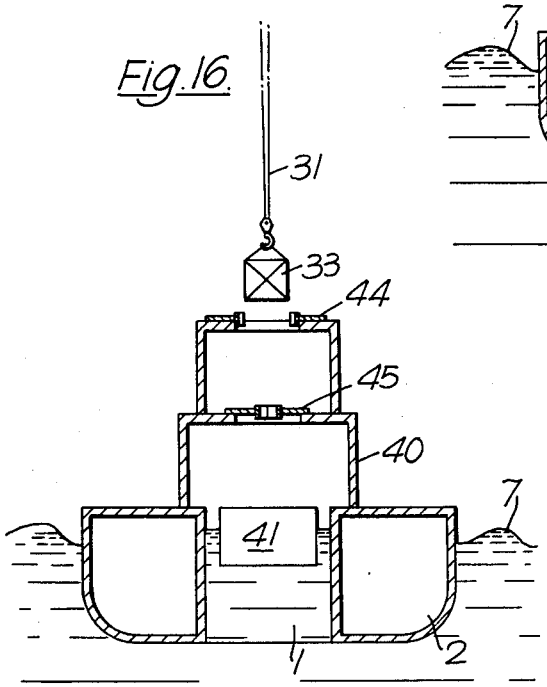

The cargo can then be lifted through the lower opening 43, FIG. 14 the opening 43 is closed, FIG. 15 and the upper opening 42 opened to enable the cargo to be lifted therethrough, FIG. 16.

Figure 13:
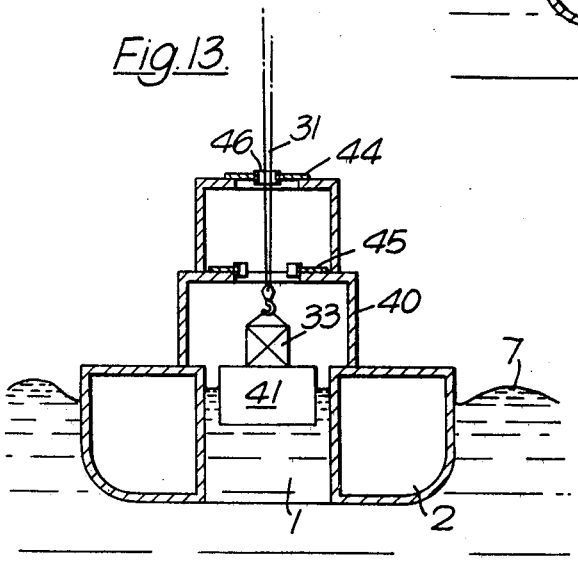

For loading cargo from the rig 30 to the vessel, the procedure is to lower the cargo through the upper opening, FIG. 16, close the opening FIG. 15 so that the cable is located in the aperture thereof, open the lower opening and lower the cargo on to the substantially stationary pontoon, FIGS. 14 and 13, release the cable and transfer the cargo from the pontoon to the open deck.

In a third embodiment, the vessel is a semi-submersible 50 having, in this example, a rectangular deck 51, six columns 52 to 57 arranged three in each side of the deck and a pair of longitudinal buoyancy tanks 58 each connected to the lower end of three legs.

Figure 17:
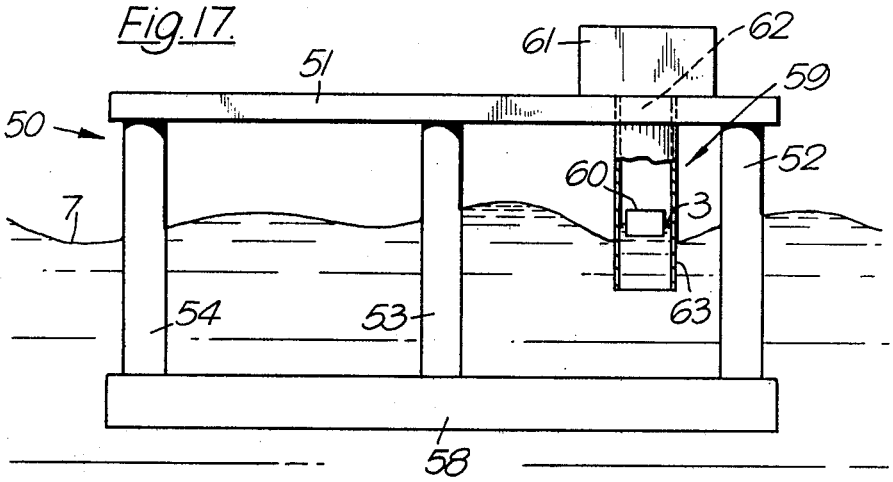
FIG. 17 illustrates a semi-submersible in its operating position having moonpool column and a pontoon therein according to the invention.
Figure 18:
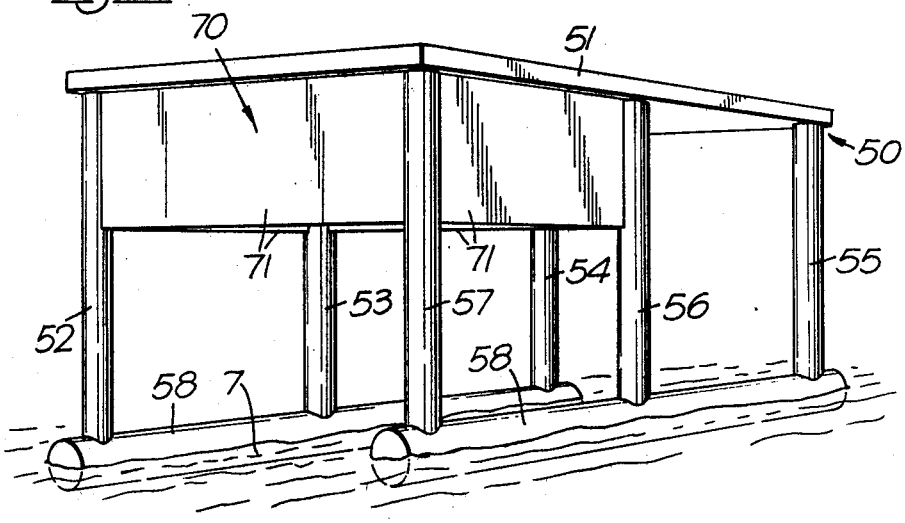
FIG. 18 illustrates a semi-submersible in its transit position showing one example of an alternative form of moonpool.

The semi-submersible is designed to vary the height of the deck above the sea surface between a raised transit position FIG. 18 in which the vessel can be towed and a lower operating position FIG. 17.

A moonpool system 59 is provided on the underside of the deck and a pontoon 60 is located therein to float on the sea surface within the moonpool when the semi-submersible is lowered to its operating position.

The moonpool system may take the form described in pending U.S. patent application Ser. No. 838,440, filed Sept. 30, 1977, and its corresponding United Kingdom application No. 40859/76 and generally shown in FIG. 17; i.e. a housing 61 on the deck, a deck opening 62 in the housing and a column 63 extending downwards from said deck opening to a level which is above the sea surface when the semi-submersible is in its transit position and below the sea surface when the semi-submersible is in its operating position.

Figure 19:
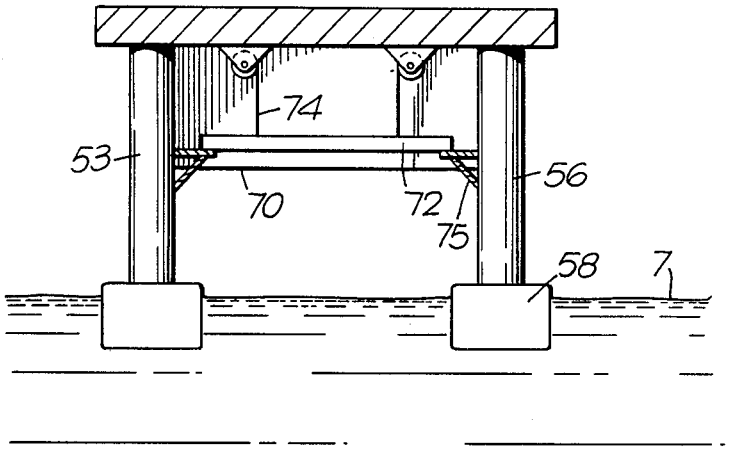
FIG. 19 is a sectional end elevation of the semi-submersible illustrated in FIG. 18 in its transit position and showing one form of pontoon support means.
Figure 20:
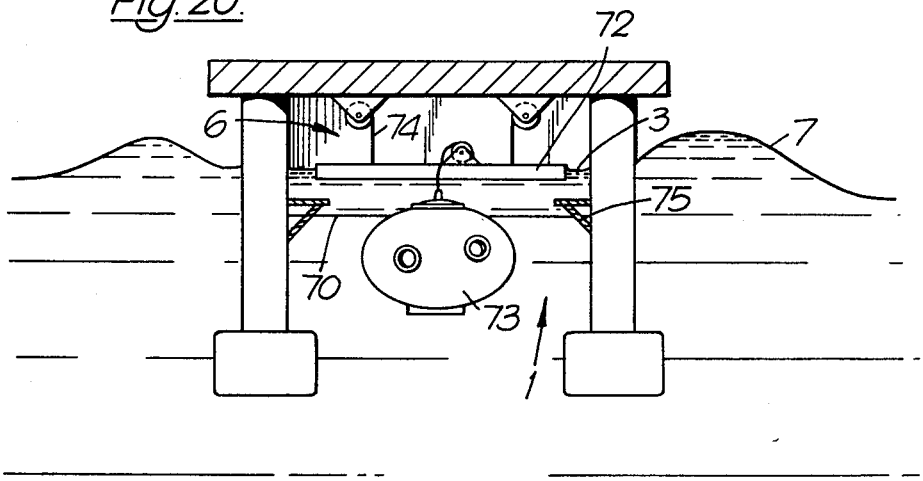
FIG. 20 shows the semi-submersible of FIG. 19 in its operating position.

Alternatively, the moonpool system as shown in FIGS. 18 to 20 is formed by a depending wall structure or skirt 70 extending from deck level to a depth similar to that defined for the column 59. The area of sea within the skirt 70 is considerably greater than in the column 59 hereinbefore mentioned, but the walls of the skirt and the underside of the deck form the required enclosed space 6 above the sea surface 3, and consequently the sea surface within the enclosed sea is calmed as in the other moonpool systems mentioned in the other embodiments. The effect of this will be that, while the semi-submersible may be subject to a heaving motion in an adverse swell, the pontoon 72 will remain stationary or substantially stationary on the sea surface 3 within the perimeter of the skirt.

A deck housing (not shown) may be provided and normally closed hatches (also not shown) may be provided for permitting access of personnel, submersibles and sub-sea equipment to the moonpool enclosure.

In this embodiment, the skirted area is formed by plating 71 located between four of the six columns, namely columns 52–53, 53–56, 56–57 and 57–52, so that the skirted area is substantially half the deck area.

Many other skirt arrangements are possible, for example by plating the peripheral space between all six columns a skirted area substantially equal to the deck area is obtained.

In another arrangement, the skirted area may be independent of the columns, the plating forming an enclosed area at any suitable location below the deck.

More than one skirted area may be provided, e.g. a skirted area may be located at one or more corners or at one end or both ends.

The pontoon 72 may be used as a stable working area and it may be adapted for launching and recovering submersibles as hereinbefore described with reference to the first embodiments, for example a tethered bell 73.

The semi-submersible is provided with lifting and or supporting means 74, 75 to enable the pontoon to be supported above sea level when the semi-submersible is in its transit position. Suitable lift means may comprise winch means in which the pontoon can be suspended below the deck when not in use; the support means may comprise brackets mounted on the skirt and/or legs which engage the underside of the pontoon as the semi-submersible rises to its upper position.

The pontoon may have an area substantially the same as the area bounded by the skirt; alternatively, it may be substantially smaller and more than one pontoon may be provided, each, for example, for different uses.

In a modification the depending skirt is formed of retractable plates which, when out-of-use, present a smaller area than that in the case of the first embodiment, thus reducing the effect of wind on the semi-submersible.

The skirt arrangements, hereinbefore described, may be provided on semi-submersibles other than the type hereinbefore described, e.g. one having other than six legs.

Advantages of a vessel installed with a pontoon, as hereinbefore described, due to the provision of the substantially stationary sea surface within the moonpool, are as follows:

(1) a free floating submersible can, for the first time, be lowered and raised through a moonpool in adverse weather conditions, because its lifting gear is mounted in the pontoon and is therefore 'decoupled' from the vessel, i.e. independent of the vessel's heaving motion, (2) the free floating submersible is supported from below, i.e. on a cradle. Its design, therefore, need no longer be dependent on the provision of strengthening for the lifting point and consequently it can have an increased pay load relative to a known free floating submersible of similar dimensions. Further, larger free floating submersibles can now be constructed without the need to provide increased strengthening for the lifting point or to provide a larger A-frame to lift such a larger submersible, (3) A tethered submersible will, for the first time, be free of large rising and falling motions caused by the surface vessel's movement in adverse weather conditions, thus providing, in such conditions, little or no physical discomfort to the occupants of the tethered submersible, (4) a tethered submersible can, when lowered to its desired depth, be moved in a sideways direction by thrusters provided on the cradle. This can be done without physical discomfort to the occupants of the submersible because of the substantially stationary holding point; thus, the tethered submersible will have a pendulous movement but substantially no rising or falling motion, (5) the substantially stationary pontoon can be used as a stable working area either on the surface of the sea within the moonpool or suspended between the surface at any suitable depth, in the form of an underwater habitat.

(6) a semi-submersible can increase its working capacity by the provision of a skirted area below its deck with one or more pontoons for location on the sea surface enclosed by the skirt.

I claim:

1. A semi-submersible comprising a deck, a plurality of columns supporting the deck above the surface of the sea, and buoyancy tanks for altering the draft of the semi-submersible between a raised transit position and a lower operating position, having a moonpool structure extending from deck level to a level which is above the waterline when the semi-submersible is in its raised (transit) position, and below the waterline when the semi-submersible is in its lower (operating) position, whereby when the semi-submersible is in its lower position an enclosed space is formed above the surface of the sea within the perimeter of said structure, said enclosed space being airtight or nearly airtight, a pontoon located in the moonpool structure and means to support said pontoon above the sea surface when the semi-submersible is in its transit position and to float the pontoon on the sea surface when the semi-submersible is in its operating position.

2. A semi-submersible according to claim 1, wherein the moonpool structure is formed by plating extending from the underside of the deck and forming an enclosed area below the deck.

3. A semi-submersible as claimed in claim 2, wherein the plating extends between at least some of the columns which support the deck above the surface of the sea.

* * * * *